US009091990B2

(12) United States Patent
Imazeki et al.

(10) Patent No.: US 9,091,990 B2
(45) Date of Patent: Jul. 28, 2015

(54) DEVICE FAILURE PREDICTOR AND IMAGE FORMING APPARATUS INCORPORATING SAME

(71) Applicants: Mikiko Imazeki, Kanagawa (JP); Yasushi Nakazato, Tokyo (JP); Akira Takehisa, Tokyo (JP); Osamu Satoh, Kanagawa (JP)

(72) Inventors: Mikiko Imazeki, Kanagawa (JP); Yasushi Nakazato, Tokyo (JP); Akira Takehisa, Tokyo (JP); Osamu Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/528,342

(22) Filed: Oct. 30, 2014

(65) Prior Publication Data

US 2015/0132017 A1 May 14, 2015

(30) Foreign Application Priority Data

Nov. 14, 2013 (JP) ..... 2013-235914

(51) Int. Cl.
*G03G 15/00* (2006.01)

(52) U.S. Cl.
CPC ..... *G03G 15/55* (2013.01); *G03G 15/553* (2013.01)

(58) Field of Classification Search
CPC .. G03G 15/55; G03G 15/553; G03G 15/5075
USPC ..... 399/8, 9, 24
See application file for complete search history.

(56) References Cited

U.S. PATENT DOCUMENTS

| | | | | |
|---|---|---|---|---|
| 8,190,037 | B2 * | 5/2012 | Nakazato et al. | 399/9 |
| 2005/0002054 | A1 | 1/2005 | Shoji et al. | |
| 2006/0182451 | A1 | 8/2006 | Shoji et al. | |
| 2006/0294252 | A1 | 12/2006 | Shoji et al. | |
| 2007/0127934 | A1 | 6/2007 | Shoji et al. | |
| 2007/0258723 | A1 | 11/2007 | Nakazato et al. | |
| 2008/0068639 | A1 | 3/2008 | Satoh et al. | |
| 2008/0075476 | A1 | 3/2008 | Nakazato et al. | |
| 2008/0199193 | A1 | 8/2008 | Nakazato et al. | |
| 2009/0033993 | A1 | 2/2009 | Nakazato et al. | |
| 2009/0034990 | A1 | 2/2009 | Nakazato et al. | |
| 2009/0052912 | A1 | 2/2009 | Soji et al. | |
| 2009/0060569 | A1 | 3/2009 | Nakazato et al. | |
| 2009/0190939 | A1 | 7/2009 | Satoh et al. | |
| 2009/0196634 | A1 | 8/2009 | Satoh et al. | |
| 2009/0319827 | A1 | 12/2009 | Nakazato et al. | |
| 2009/0322524 | A1 | 12/2009 | Nakazato et al. | |

(Continued)

FOREIGN PATENT DOCUMENTS

| | | |
|---|---|---|
| JP | 2005-017874 | 1/2005 |
| JP | 2009-003561 | 1/2009 |
| JP | 2010-104148 | 5/2010 |

OTHER PUBLICATIONS

Shinto Eguchi, "Information geometry of statistical pattern identification", Mathematical Sciences No. 489, Mar. 2004, 2 pgs.

*Primary Examiner* — Hoang Ngo
(74) *Attorney, Agent, or Firm* — Oblon, McClelland, Maier & Neustadt, L.L.P.

(57) ABSTRACT

A device failure predictor includes data acquisition unit to acquire internal data of a target device, a peak value calculator to calculate a plurality of peak values of the internal data for a prescribed period of time, and a failure sign identification unit to set individual criteria for the plurality of peak values and determine whether or not the target device shows signs of failure according to the plurality of peak values and the individual criteria.

7 Claims, 7 Drawing Sheets

(56) References Cited

U.S. PATENT DOCUMENTS

| | | | |
|---|---|---|---|
| 2009/0324259 | A1 | 12/2009 | Ue et al. |
| 2010/0094594 | A1 | 4/2010 | Yamashita et al. |
| 2010/0098471 | A1 | 4/2010 | Satoh et al. |
| 2011/0004419 | A1 | 1/2011 | Ue et al. |
| 2011/0007337 | A1 | 1/2011 | Imazeki et al. |
| 2011/0052224 | A1 | 3/2011 | Yamashina et al. |
| 2011/0170884 | A1 | 7/2011 | Yamane et al. |
| 2011/0206393 | A1 | 8/2011 | Nakazato et al. |
| 2012/0065885 | A1 | 3/2012 | Imazeki et al. |
| 2013/0028615 | A1 | 1/2013 | Satoh et al. |
| 2013/0251383 | A1 | 9/2013 | Imazeki et al. |
| 2013/0272723 | A1 | 10/2013 | Imazeki et al. |
| 2014/0016951 | A1 | 1/2014 | Takehisa et al. |

* cited by examiner

DEVICE FAILURE PREDICTOR AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application No. 2013-235914, filed on Nov. 14, 2013, in the Japan Patent Office, the entire disclosure of which is hereby incorporated by reference herein.

BACKGROUND

1. Technical Field

Embodiments of the present invention generally relate to a device failure predictor for predicting a failure of a device, and to an image forming apparatus incorporating the device failure predictor.

2. Background Art

Various types of electrophotographic image forming apparatuses are known, including copiers, printers, facsimile machines, or multifunction machines having two or more of copying, printing, scanning, facsimile, plotter, and other capabilities.

Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A development device supplies toner to the electrostatic latent image thus formed to render the electrostatic latent image visible as a toner image. The toner image is then transferred onto a recording medium directly, or indirectly via an intermediate transfer belt. Finally, a fixing device applies heat and pressure to the recording medium carrying the toner image to fix the toner image onto the recording medium. Thus, the image is formed on the recording medium.

Usually, failures and/or lifetimes of such image forming apparatuses are predicted using internal data thereof to efficiently keep the image forming apparatuses in proper condition.

SUMMARY

In one embodiment of the present invention, an improved device failure predictor is described that includes a data acquisition unit to acquire internal data of a target device, a peak value calculator to calculate a plurality of peak values of the internal data for a prescribed period of time, and a failure sign identification unit to set individual criteria for the plurality of peak values and determine whether or not the target device shows signs of failure according to the plurality of peak values and the individual criteria.

Also described is an improved image forming apparatus incorporating a device failure predictor that includes a data acquisition unit to acquire internal data of a target device, a peak value calculator to calculate a plurality of peak values of the internal data for a prescribed period of time, and a failure sign identification unit to set individual criteria for the plurality of peak values and determine whether or not the target device shows signs of failure according to the plurality of peak values and the individual criteria.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
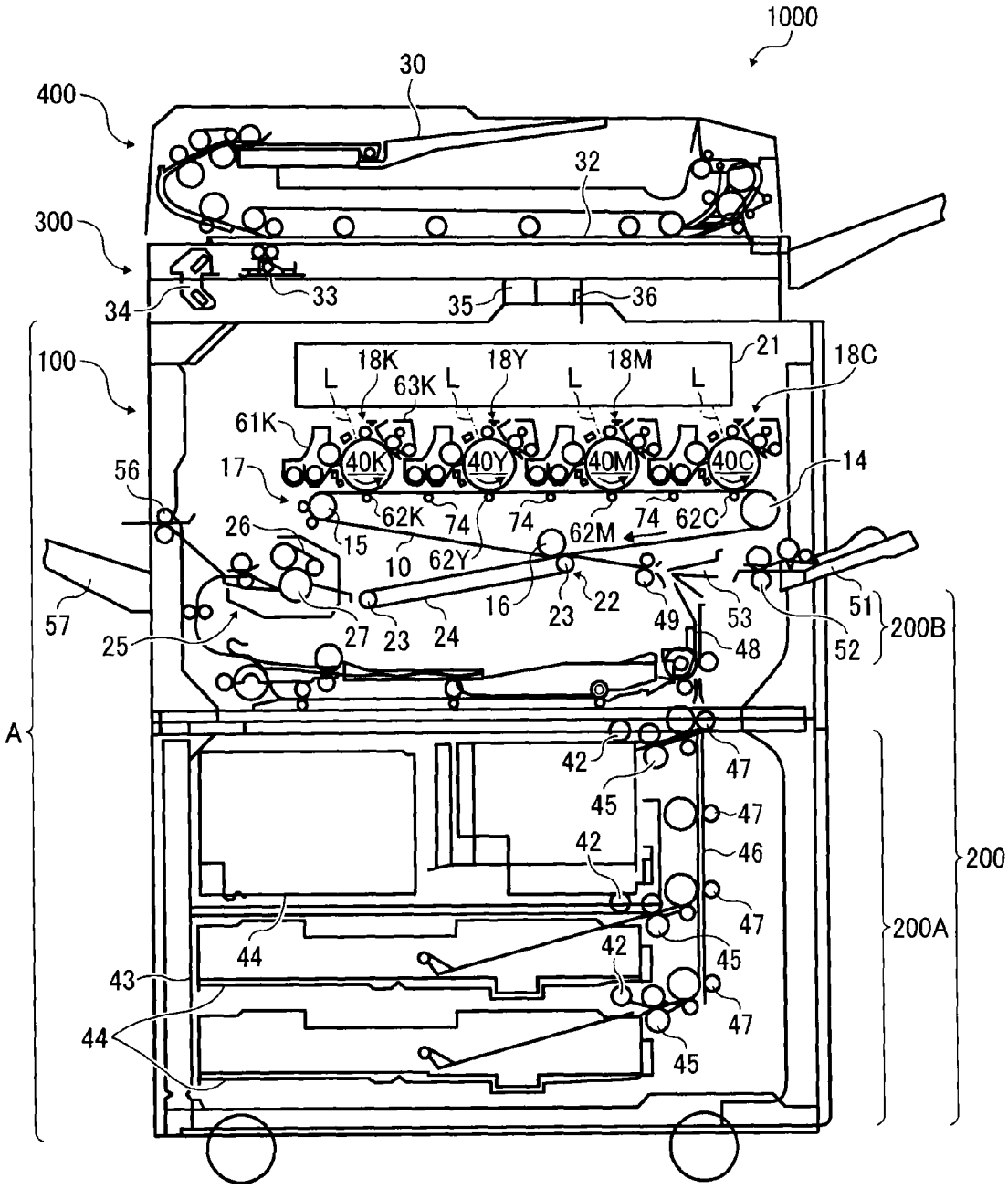
FIG. 1 is a schematic view of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and not all of the components or elements described in the embodiments of the present invention are indispensable.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

Referring now to the drawings, wherein like reference numerals designate identical or corresponding parts throughout the several views, embodiments of the present invention are described below.

Initially with reference to FIG. 1, a description is given of an overall configuration and operation of an image forming apparatus 1000 according to an embodiment of the present invention.

FIG. 1 is a schematic view of the image forming apparatus 1000. In the present embodiment, the image forming apparatus 1000 is a color copier. The image forming apparatus 1000 includes an image forming section A, a scanner 300, and a document feeder 400. The image forming section A includes a printer unit 100 and a feeder 200. The scanner 300 is disposed atop the printer unit 100. The document feeder 400 is disposed atop the scanner 300. In the present embodiment, the document feeder 400 is an automatic document feeder (ADF).

Figure 2:
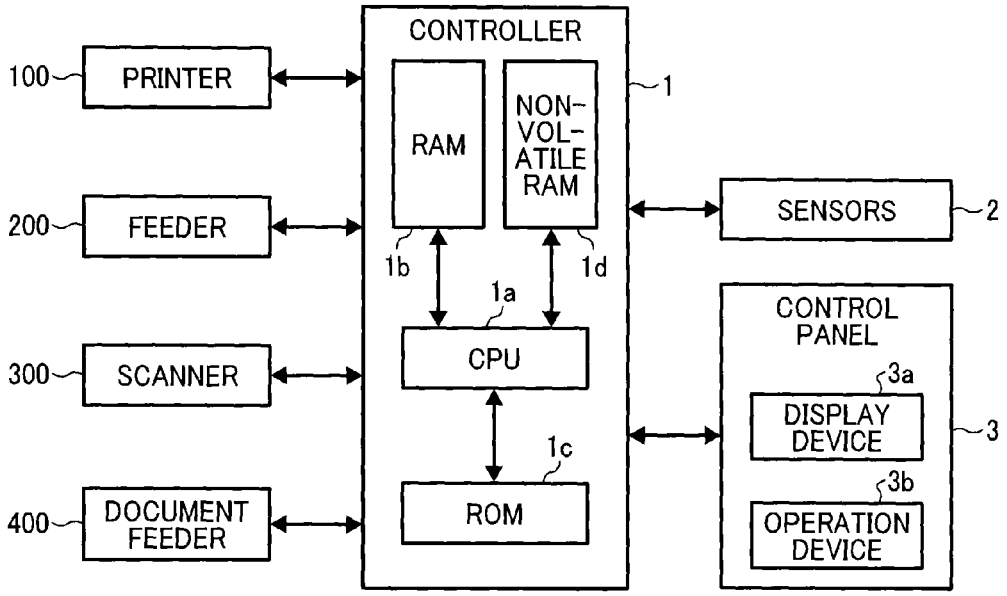
FIG. 2 is a block diagram of a control system of the image forming apparatus of FIG. 1.

The scanner 300 includes a contact glass 32, first and second carriers 33 and 34, an imaging lens 35, and a sensor 36. The scanner 300 reads image data of a document placed on the contact glass 32 with the sensor 36, and sends the image data thus read to a controller 1, which is illustrated in FIG. 2. According to the image data received from the scanner 300, the controller 1 controls, e.g., a laser and an LED array disposed inside an exposure device 21 to irradiate surfaces of four drum-shaped photoconductors 40K, 40Y, 40M, and 40C with laser beams L. The exposure device 21 and the photoconductors 40K, 40Y, 40M, and 40C are included in the printer unit 100, disposed facing each other. Thus, an electrostatic latent image is formed on each of the surfaces of the photoconductors 40K, 40Y, 40M, and 40C, and developed into a visible toner image through a predetermined development process. It is to be noted that suffixes K, Y, M, and C denote colors black, yellow, magenta, and cyan, respectively. To simplify the description, these suffixes may be omitted unless necessary in the following description.

In addition to the exposure device 21 and the photoconductors 40, the printer unit 100 includes, e.g., primary transfer rollers 62K, 62Y, 62M, and 62C, a secondary transfer device 22, a fixing device 25, a discharge device such as a pair of discharge rollers 56, and a toner supplier.

The feeder 200 includes an automatic feeding section 200A disposed below the printer unit 100, and a manual bypass section 200B provided on a side of the printer unit 100. The automatic feeding section 200A includes, e.g., a paper bank 43 that accommodates a plurality of trays 44 disposed one above the other, feed rollers 42 each of which picks up a recording medium from the corresponding tray 44, pairs of first separation rollers 45 each of which separates the recording medium from the corresponding tray 44 and sends the recording medium to a first conveyance passage 46, and pairs of conveyor rollers 47 each of which conveys the recording medium toward a second conveyance passage 48. The bypass section 200B includes, e.g., a bypass tray 51 and a pair of second separation rollers 52 that separates a recording medium from another one placed on the bypass tray 51 to send the recording medium thus separated toward a bypass conveyance passage 53.

A pair of registration rollers 49 is disposed around an end of the second conveyance passage 48 in the printer unit 100. The pair of registration rollers 49 receives the recording medium sent from one of the trays 44 or from the bypass tray 51, and then sends the recording medium at a predetermined time to a secondary transfer nip formed between the secondary transfer device 22 and an intermediate transfer belt 10 serving as an intermediate transfer body.

An operator, for example, places a document on a document table 30 of the document feeder 400 to copy a color image. Alternatively, the operator opens the document feeder 400 to place the document on the contact glass 32 of the scanner 300, and then closes the document feeder 400 to press the document against the contact glass 32. Thereafter, the operator presses a start button. The scanner 300 is activated after the document is conveyed onto the contact glass 32 if the document is placed on the document feeder 400. Alternatively, the scanner 300 is activated immediately if the document is placed on the contact glass 32. Specifically, the first and second carriers 33 and 34 move, and light emitted from a light source of the first carrier 33 is reflected from a surface of the document toward the second carrier 34. The light is then reflected from a mirror of the second carrier 34 and reaches the sensor 36 via the imaging lens 35. The sensor 36 reads the light as image data.

When the image data is read as described above, the printer unit 100 rotates one of support rollers 14, 15, and 16 with a drive motor so that the other two support rollers are rotated. The support rollers 14, 15, and 16 endlessly rotate the intermediate transfer belt 10 that is entrained around the support rollers 14, 15, and 16. Also, as described above, the exposure device 21 irradiates the surfaces of the photoconductors 40 with the laser beams L to form latent images thereon. The latent images are formed into toner images of black, yellow, magenta, and cyan on the photoconductors 40K, 40Y, 40M, and 40C, respectively, while the photoconductors 40K, 40Y, 40M, and 40C are rotating. Sequentially, the toner images are electrostatically transferred onto the intermediate transfer belt 10 at respective primary transfer nips where the intermediate transfer belt 10 contacts the photoconductors 40K, 40Y, 40M, and 40C, so that the toner images are superimposed one atop another on the intermediate transfer belt 10 to form a four-color toner image thereon.

In the meantime, the feeder 200 rotates one of the three feed rollers 42 to direct a recording medium having an appropriate size for the image data toward the second conveyance passage 48 of the printer unit 100. When the recording medium reaches the pair of registration rollers 49 through the second conveyance passage 48, the pair of registration rollers 49 temporarily stops the recording medium, and then conveys the recording medium at a predetermined time toward the secondary transfer nip where the intermediate transfer belt 10 contacts a secondary transfer roller 23 of the secondary transfer device 22. At the secondary transfer nip, the four-color toner image formed on the intermediate transfer belt 10 and the recording medium are synchronized to stick together. A transfer electrical field and physical pressure at the secondary transfer nip transfers the four-color toner image onto the recording medium to form a full-color toner image thereon with a white color of the recording medium.

After passing through the secondary transfer nip, the recording medium is conveyed to the fixing device 25 as a conveyor belt 24 of the secondary transfer device 22 endlessly rotates. In the fixing device 25, the full-color toner image is fixed onto the recording medium under pressure applied by a pressing roller 27 and heat applied by a heating belt 26. Thereafter, the recording medium is discharged by the pair of discharge rollers 56 onto a discharge tray 57 provided on a side of the printer unit 100.

The printer unit 100 includes a belt unit, four process units 18K, 18Y, 18M, and 18C to form toner images of black, yellow, magenta, and cyan, a belt cleaner 17, the fixing device 25, and the like.

The belt unit endlessly moves the intermediate transfer belt 10, entrained around the support rollers 14, 15, and 16, in contact with the photoconductors 40K, 40Y, 40M, and 40C. At the primary transfer nips where the intermediate transfer belt 10 contacts the photoconductors 40K, 40Y, 40M, and 40C, the primary transfer rollers 62K, 62Y, 62M, and 62C presses the back surface of the intermediate transfer belt 10 against the photoconductors 40K, 40Y, 40M, and 40C. A primary transfer bias is applied to each of the primary transfer rollers 62K, 62Y, 62M, and 62C by a power source to form a primary transfer electrical field that electrostatically moves the toner images from the photoconductors 40K, 40Y, 40M, and 40C to the intermediate transfer belt 10 at the primary transfer nips. Conductive rollers 74 are disposed between adjacent rollers of the primary transfer rollers 62K, 62Y, 62M, and 62C to contact the back surface of the intermediate transfer belt 10. The conductive rollers 74 prevent the primary transfer bias applied to the primary transfer rollers 62K, 62Y, 62M, and 62C from flowing into the respective process units 18K, 18Y, 18M, and 18C via a base layer having a middle resistance of the back surface of the intermediate transfer belt 10.

Each of the process units 18 includes the photoconductor 40 and other equipment, and is removable from the printer unit 100 as a unit. For example, the process unit 18K to form a black toner image includes the photoconductor 40K, a developing device 61K that develops an electrostatic latent image formed on the surface of the photoconductor 40K into a black toner image, and a photoconductor cleaner 63K that removes residual toner, which fails to be transferred from the surface of the photoconductor 40K to the intermediate transfer belt 10 at the primary transfer nip and therefore remaining on the surface of the photoconductor 40K, from the surface of the photoconductor 40K. The process unit 18K further includes a discharging device that discharges the surface of the photoconductor 40K from which the residual toner is removed, and a charging device that uniformly charges the discharged surface of the photoconductor 40K. The process units 18 are identical in configuration, differing only in color of toner employed. In the present embodiment, the process units 18K, 18Y, 18M, and 18C are arranged side by side along a direction in which the intermediate transfer belt 10 rotates.

Figure 3:
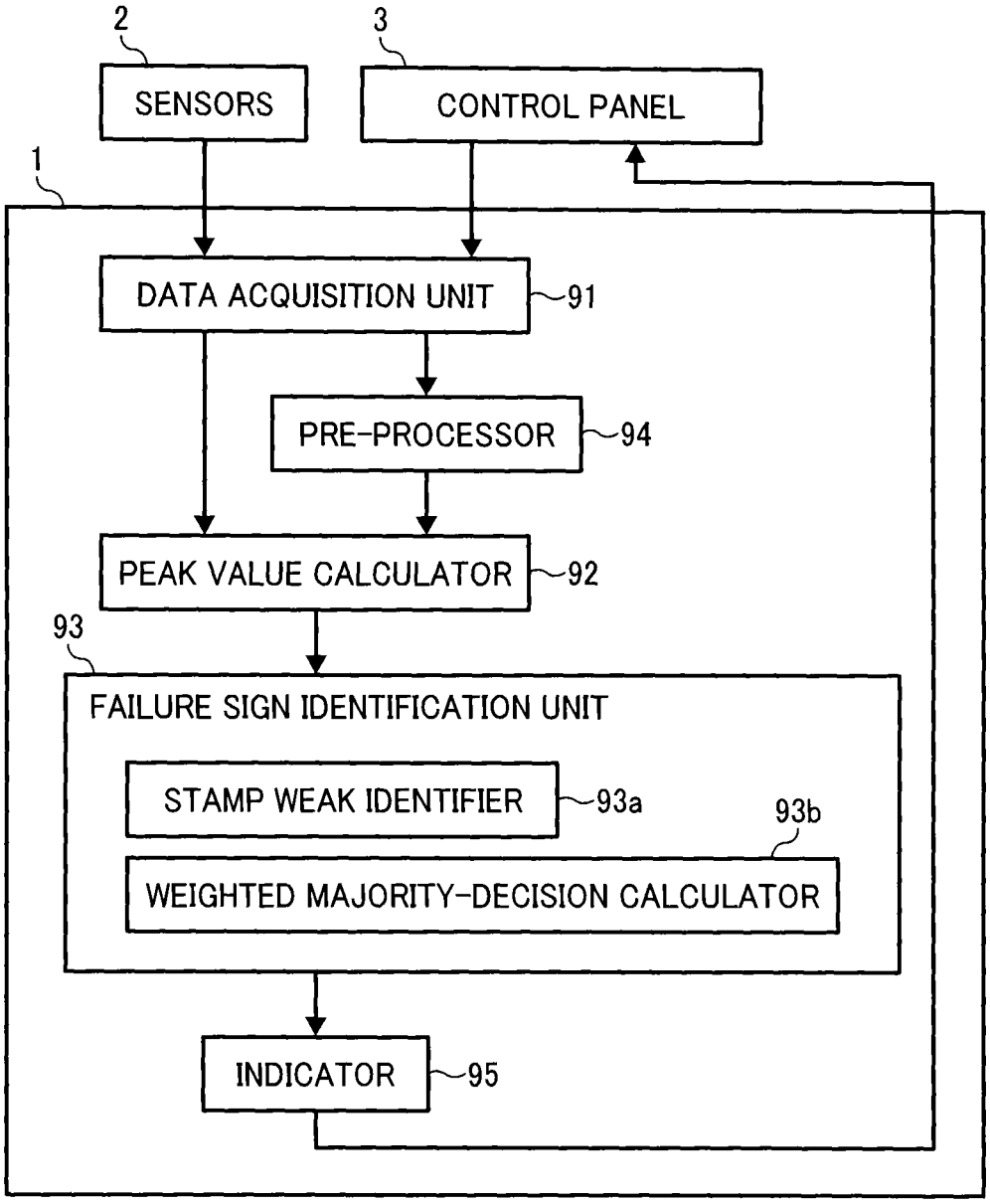
FIG. 3 is a functional block diagram of a controller.

Referring now to FIGS. 2 and 3, a description is given of a controller 1 serving as a device failure predictor of the image forming apparatus 1000.

FIG. 2 is a block diagram of a control system of the image forming apparatus 1000 described above. FIG. 3 is a functional block diagram of the controller 1.

Initially, a description is given of a data acquisition unit 91 to acquire internal data of a target device. Some components of the image forming apparatus 1000 periodically acquire characteristic values useful for limiting components involved in a failure occurring in the image forming apparatus 1000 by review of movement just before the failure occurs. In the present embodiment, the controller 1 acquires the characteristic value through, e.g., sensors 2 and the control panel 3 illustrated in FIG. 2.

The controller 1 exerts overall control of the image forming apparatus 1000, and includes, e.g., a central processing unit (CPU) 1*a* serving as a calculator, a random access memory (RAM) 1*b* that stores, e.g., calculation data and a control parameter, a read-only memory (ROM) 1*c* that stores a control program, and a nonvolatile RAM 1*d* that stores data. The control panel 3 includes, e.g., a display device 3*a* and an operation device 3*b*. The display device 3*a* is, in the present embodiment, a liquid crystal display that displays, e.g., text information. The operation device 3*b* receives input data through a ten key or the like and sends the input data to the controller 1.

As described above, the controller 1 acquires a plurality of characteristic values such as a charging potential of the photoconductor 40, sensing data, control parameter data, input image data. A detailed description is now given of the sensing data, the control parameter data, and the input image data.

The sensing data includes, e.g., a drive relationship, recording medium characteristics, developer characteristics, photoconductor characteristics, electrophotographic processing conditions, environmental conditions, and recording material characteristics.

With respect to the control parameter data, it is effective to directly use input/output parameters of the controller 1 such as image forming parameters and cumulative operating time data because the controller 1 determines operation of the image forming apparatus 1000.

The input image data includes, e.g., image data sent directly from a host computer or processed image data of a document read by the scanner 300. From such input image data, various data can be acquired. For example, the cumulative number of color pixels can be acquired by separately counting image data of red, green, and blue signals for each pixel. An original image is divided into, e.g., character, halftone dot, photograph, and background parts to acquire the rates of the character part, halftone part, and the like. Similarly, the rate of color characters can be acquired. Distribution of toner consumed in a main scanning direction can be acquired by counting the cumulative number of color pixels for each area defined in the main scanning direction. An image size can be acquired based on a distribution of color pixels in the image data or an image size signal generated by the controller 1. The type of character including size and font can be acquired from attribute data of the character.

The controller 1 periodically samples various data such as those described above to store the data in the nonvolatile RAM 1*d*.

A description is now given of a peak value calculator 92 to calculate a plurality of peak values (the highest values and/or the lowest values) of internal data of the image forming apparatus 1000 for a prescribed period of time. The internal data is used to predict a failure and/or lifetime of the image forming apparatus 1000. The prescribed period of time is determined based on operating time or the number of printed sheets.

One way of determining the prescribed period of time is using a lifetime or a fraction of a lifetime of a component of the image forming apparatus 1000 subject to diagnosis. For example, a tenth part of the lifetime of the component subject to diagnosis is determined as the prescribed period of time.

Another way of determining the prescribed period of time is using machine learning. For example, a prescribed period of time is determined such as a tenth part of the lifetime of the component subject to diagnosis, and machine learning such as boosting is performed. The length of the prescribed period of time is then changed for printing, e.g., +10,000 sheets or −10,000 sheets, and machine learning is performed again to create classifiers for the respective lengths of time. The classifiers are tested using cumulative past internal signal data in normal and abnormal states to select a period of time for which more failures are classified as the prescribed period of time.

Yet another way of determining the prescribed period of time is using a histogram. For example, using cumulative past internal signal data, a threshold is set to determine an abnormal value to obtain the number of printed sheets from when the internal signal exceeds the threshold until when a failure occurs. Thus, a histogram is created to determine the prescribed period of time. In the histogram, for example, the horizontal axis indicates the number of printed sheets from when the internal signal exceeds the threshold until when the failure occurs, while the vertical axis indicates frequencies. For example, if the histogram shows lower frequencies when the number of printed sheets exceeds 100,000 while the frequencies gradually increase as the number of printed sheets decreases from 100,000 sheets, a period of time of printing 100,000 sheets is determined as the prescribed period of time.

Figure 4:
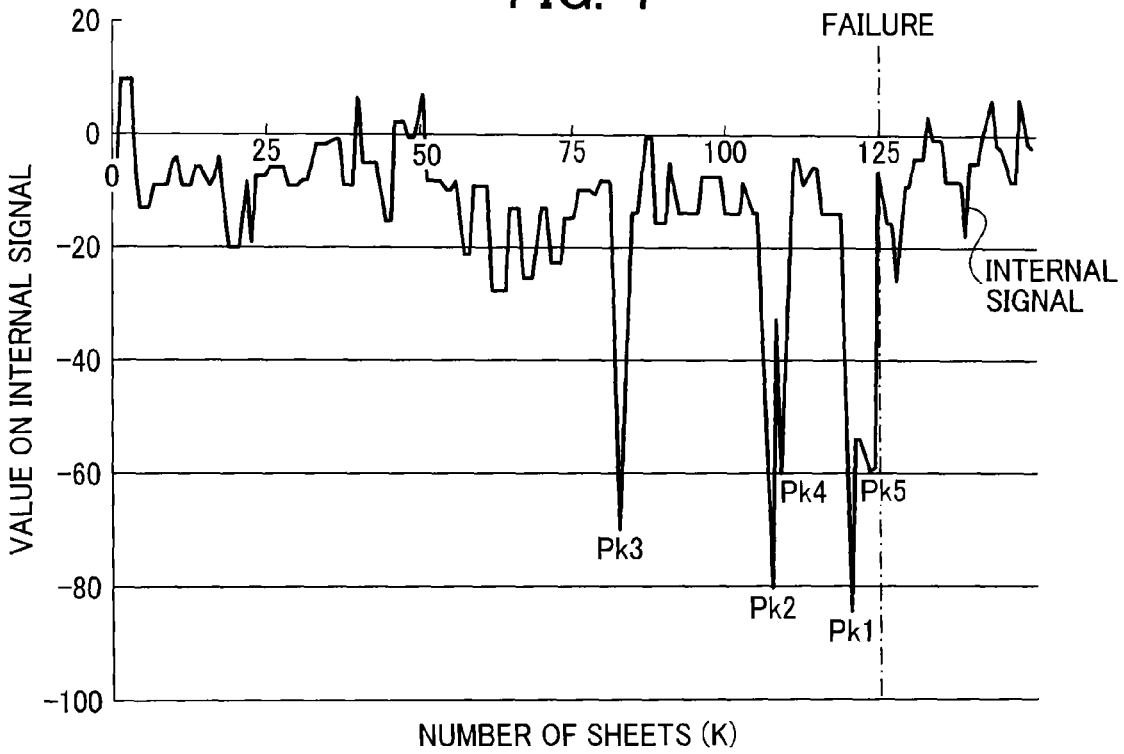
FIG. 4 is a time-series graph of an internal signal.

In an embodiment of the present invention, five peak values (the lowest values) are calculated for a period of time of printing 100,000 sheets. FIG. 4 is a time-series graph of an internal signal. The horizontal axis indicates the number of printed sheets (K =thousand). In FIG. 4, a failure occurs when 125,000 sheets are printed. Among about 100,000 sheets (about 24,000 sheets to about 124,000 sheets) printed just before the failure occurs, the five peak values (the lowest values) are calculated, which are indicated as Pk1 through Pk5 in FIG. 4. To calculate peak values (highest or lowest values), for example, the CPU 1*a* serving as the peak value calculator 92 acquires internal signal data for a past prescribed period of time from the RAM 1*b*. The CPU 1*a* calculates the peak values of the internal signal data thus acquired.

Although FIG. 4 shows the lowest values as peak values Pk1 through Pk5, the peak values may be the highest values depending on the signal.

With a boosting algorithm, the signal is classified into a portion for an abnormal period of time and a portion for a normal period of time. If an unexpected value is used to identify occurrence of a failure, learning may be adversely affected because the portion for the abnormal period of time has substantially the same value as the portion for the normal period of time except for the unexpected value. However, by handling a peak value as a feature amount within a period of time, the signal value for the abnormal period of time may be distinguished from the signal value for the normal period of time. Although the signal may have an unexpected value for the normal period of time, handling a plurality of peak values as feature amounts may prevent erroneous indication due to the unexpected value.

A description is now given of a failure sign identification unit 93 of the controller 1 that determines whether or not a target device shows signs of failure according to the peak values calculated by the peak value calculator 92.

Individual criteria (thresholds) are set for the peak values (e.g., five peak values) calculated. If all five peak values exceed their respective thresholds, it is determined that a failure occurs. Alternatively, if a predetermined number or more of peak values (e.g., three or more peak values) of the five peak values exceed their respective thresholds, it may be determined that a failure occurs. The thresholds may be determined visually from a chronological line graph, as illustrated in FIG. 4, of data acquired during normal operation for a past prescribed period of time before a failure has occurred.

Alternatively, a threshold and a weight of each peak value may be calculated mechanically using boosting to calculate an F-value. If the F-value exceeds the threshold, it may be determined that a failure occurs.

A description is now given of a pre-processor 94.

Figure 5:
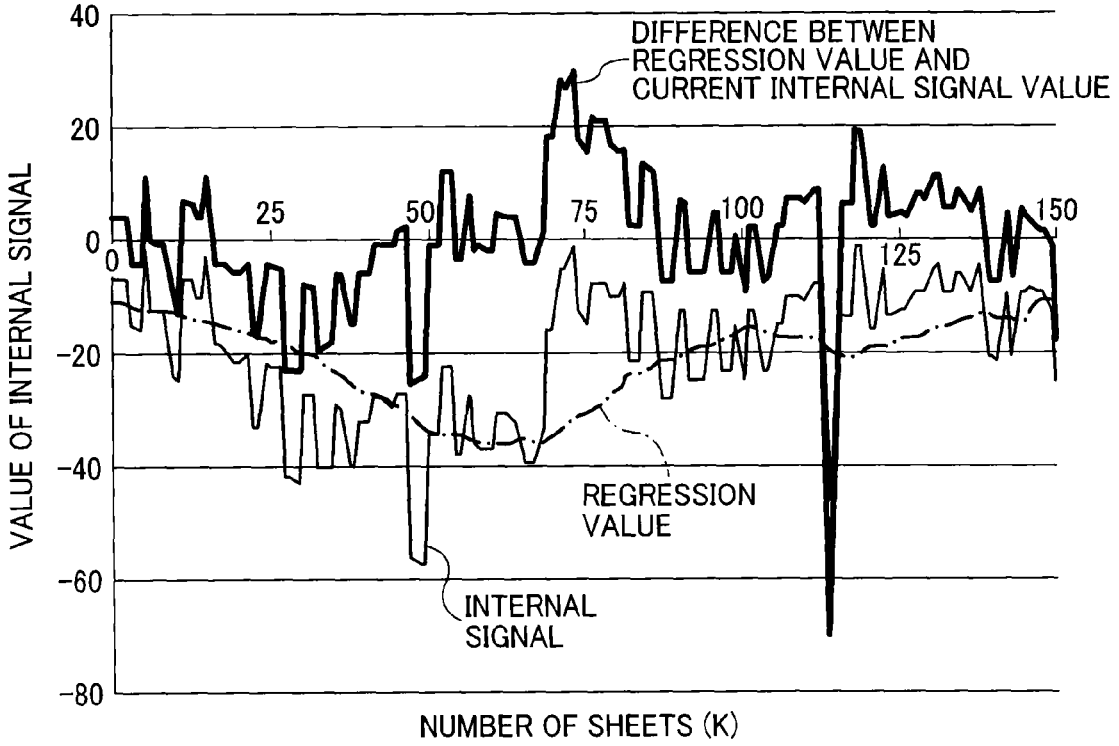
FIG. 5 is a time-series graph of an internal signal and a regression value.

First, a regression value of fluctuated internal signal is calculated. For example, the regression value is calculated by smoothing using, e.g., a moving average. A parameter is determined to control smoothness. In FIG. 5, the broken line indicates the regression value calculated, while the thin line indicates the current internal signal value. The thick line indicates the difference between the regression value and the current internal signal value, which is obtained to accurately extract peak values that show unexpected changes of value. The peak value calculator 92 calculates peak values according to the difference between the regression value and the current internal signal value. The peak values are used as feature amounts.

A description is now given of the F-value.

An F-value calculator calculates an F-value. A plurality of signals appropriate for calculation of the F-value are extracted because when a stable signal during normal operation shows a peculiar unstable movement, the signal is deemed to show signs of failure. The F-value is calculated by boosting.

A description is now given of a stamp weak classifier 93*a*, weighted majority-decision calculator 93*b*, and boosting.

In the present embodiment, a reference value "b" and a weight "α" are created for failure prediction using a supervised learning algorithm generally called boosting.

First, a group of multiple types of data is prepared including respective histories from a normal state to an abnormal state. The histories of data are illustrated in a graph showing fluctuation over time, from which an abnormal period of time is assumed visually. The data are classified into a negative polarity corresponding to data for the abnormal period of time and a positive polarity corresponding to data for a normal period of time. This operation is repeated 100 times to determine thresholds b1 through b100, polarities sgn1 through sgn 100, and weighted values α1 through α100 for each type of data.

Then, according to time signals of the data, it is determined whether each type of data is in a normal state or in an abnormal state. The determination is referred to a weak determination process because it is not a critical element for failure prediction. The weak determination process is performed using the following equations:

$$OUT_i=1\ \{sgn_i\times(c_i-b_i)\} \quad (1)$$

$$OUT_i=-1\ \{sgn_i\times(c_i-b_i)\} \quad (2)$$

where $c_i$ represents a time signal. Specifically, if $(c_i-b_i)\geq 0$, Equation 1 is used. If $(c_i-b_i)<0$, Equation 2 is used.

After the weak determination process, the F-value is calculated, which is used for failure prediction.

$$F=\Sigma\alpha_i\times OUT_i \quad (3)$$

The above-described thresholds, polarities, and weighted values are determined such that, among the identified, supervised data, data appropriately learned and corresponding to the abnormal period of time have F-values with negative polarity. Accordingly, if an F-value with negative polarity is obtained by Equation 3, it is assumed that an abnormal period of time has come.

Thus, if a failure is predicted by the F-value with negative polarity, the image forming apparatus 1000 may be notified of the failure prediction as an alarm via a network such as a local area network (LAN). Alternatively, a maintenance operator or the like may receive an alarm e-mail via the network. Alternatively, for example, the control panel 3 may display a message prompting replacement of deteriorating developer with new developer.

A description is now given of a signal having an expected drastic change, resulting in a failure, using a parameter that shows developing ability.

The difference (Δ developing γ) between a target developing gamma (γ) and a current developing gamma (γ) is one such signal having an expected drastic change, resulting in a failure.

The developing γ is a ratio of a developing potential ΔV and an amount of toner adhering to a photoconductor (e.g., photoconductor 40) as an image carrier, which generally stays constant. It is to be noted that the developing potential ΔV is obtained by subtracting a developing bias VB applied to a developing roller from a charging potential Vs of the photoconductor (i.e. ΔV=Vs−VB). A developing γ at a predetermined level or lower may cause an image failure or cause carriers to adhere to the photoconductor, resulting in a reduction in image quality. To avoid such reduction in image quality, a process control (hereinafter referred to as a developing γ adjustment control) is typically performed to adjust settings so that the developing γ is within a predetermined range at a predetermined time, such as when image formation is performed a predetermined number of times (e.g., 200 times), when the power is turned on, or when the apparatus operating mode returns from power-saving mode.

In the developing γ adjustment control, a reference latent image formed on the photoconductor is developed into a visible toner image for measurement with a two-component developer. An amount of toner contained in the toner image is detected to calculate a developing γ. Settings relative to the developing potential ΔV (e.g., the charging potential V on the photoconductor and the developing bias VB) are adjusted such that the developing γ thus calculated is an empirically ideal value. The developing γ depends on the toner density of two-component developer. However, the toner density is not usually adjusted upon developing γ adjustment control in the image forming apparatuses, because it relatively takes time to adjust the toner density. Accordingly, the image forming apparatuses typically shorten time for the developing γ adjustment control to enhance the convenience for, e.g., users.

The toner density of two-component developer is adjusted, upon image forming, by supplying toner until a toner density sensor detects target density. Such developing γ adjustment control normally maintains the developing γ within the predetermined range. However, the developing γ may be out of the predetermined range upon occurrence of mechanical failures, such as a failure of development device, a toner supply failure, or a failure of writing a latent image on the photoconductor. Since such a mechanical failure requires device repair, the image forming apparatuses typically indicate that the developing γ is in an abnormal state so that the image forming apparatuses can be kept in proper condition.

If the developing γ is out of control, the difference between the target developing γ and the current developing gamma γ (Δ developing γ=current developing gamma γ−target developing γ) increases.

Figure 6:
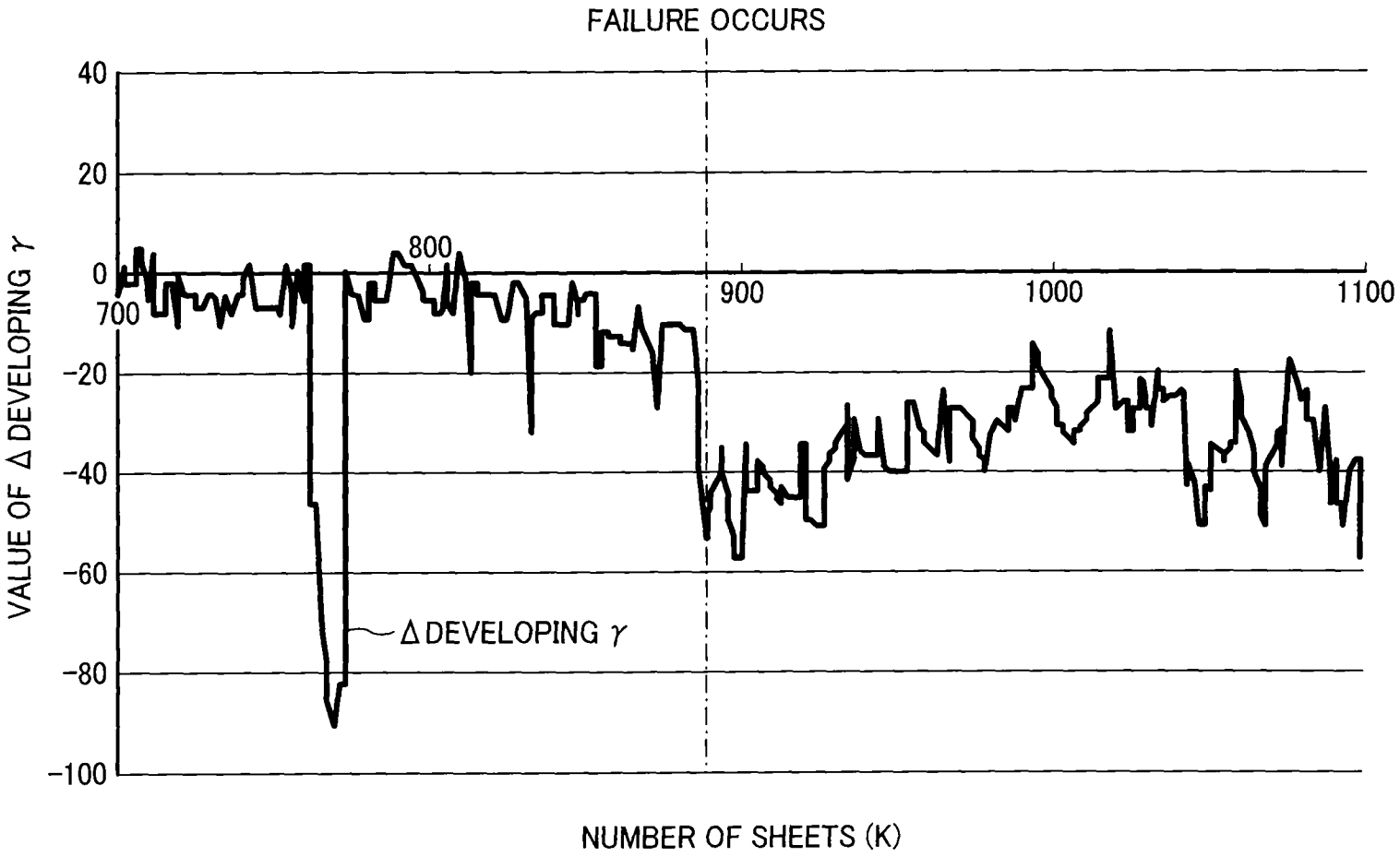
FIG. 6 is a graph of a fluctuated Δ developing γ over time.

FIG. 6 is a graph of a fluctuated Δ developing γ over time. The horizontal axis indicates the number of printed sheets (K) while the vertical axis indicates value of Δ developing γ. A failure occurs when about 890,000 sheets are printed. Before that, the Δ developing γ suddenly decreases when about 770,000 sheets are printed. In the present embodiment, a failure is predicted based on such an unexpected, drastic change of value.

Figure 7:
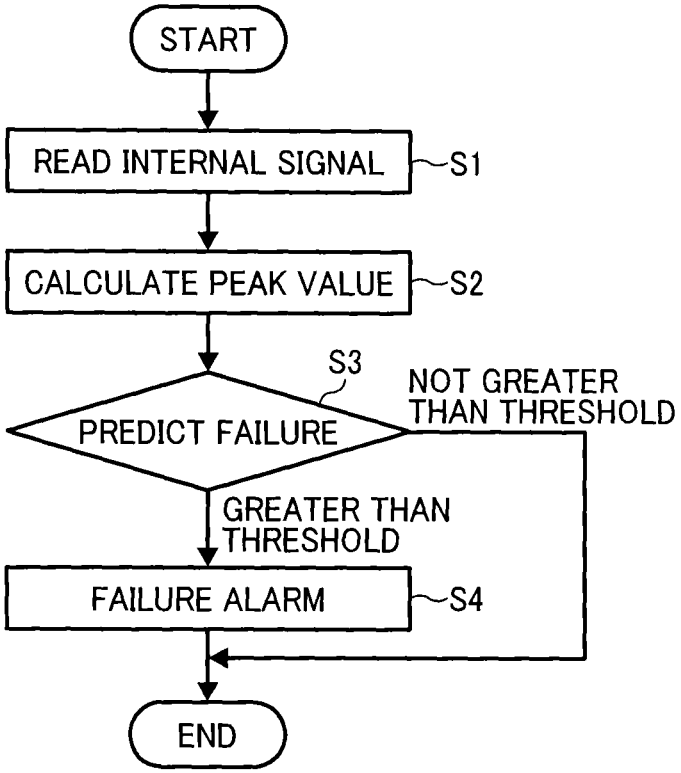
FIG. 7 is a flowchart of a failure prediction control process according to a first embodiment of the present invention.

FIG. 7 is a flowchart of a failure prediction control process according to a first embodiment of the present invention.

In step 1 (S1), an internal signal stored in the RAM 1*b* as needed is read. In step 2 (S2), the peak value calculator 92 calculates a peak value. In step 3 (S3), a failure is predicted according to the peak value thus calculated. In other words, a failure is predicted by comparison and calculation of whether or not the peak value is greater than a predetermined threshold. If the peak value is greater than the threshold in step 3, a failure alarming is performed to indicate signs of failure in step 4 (S4). As one example of the failure alarming as an indicator 95 to indicate signs of failure, the display device 3*a* of the control panel 3 displays an alarm message. Alternatively, the image forming apparatus 1000 may be notified of the signs of failure as an alarm via a LAN, or a maintenance operator may receive an alarm email via the LAN. On the other hand, if the peak value is not greater than the threshold in step 3, the failure alarming is not performed to complete the process.

Figure 8:
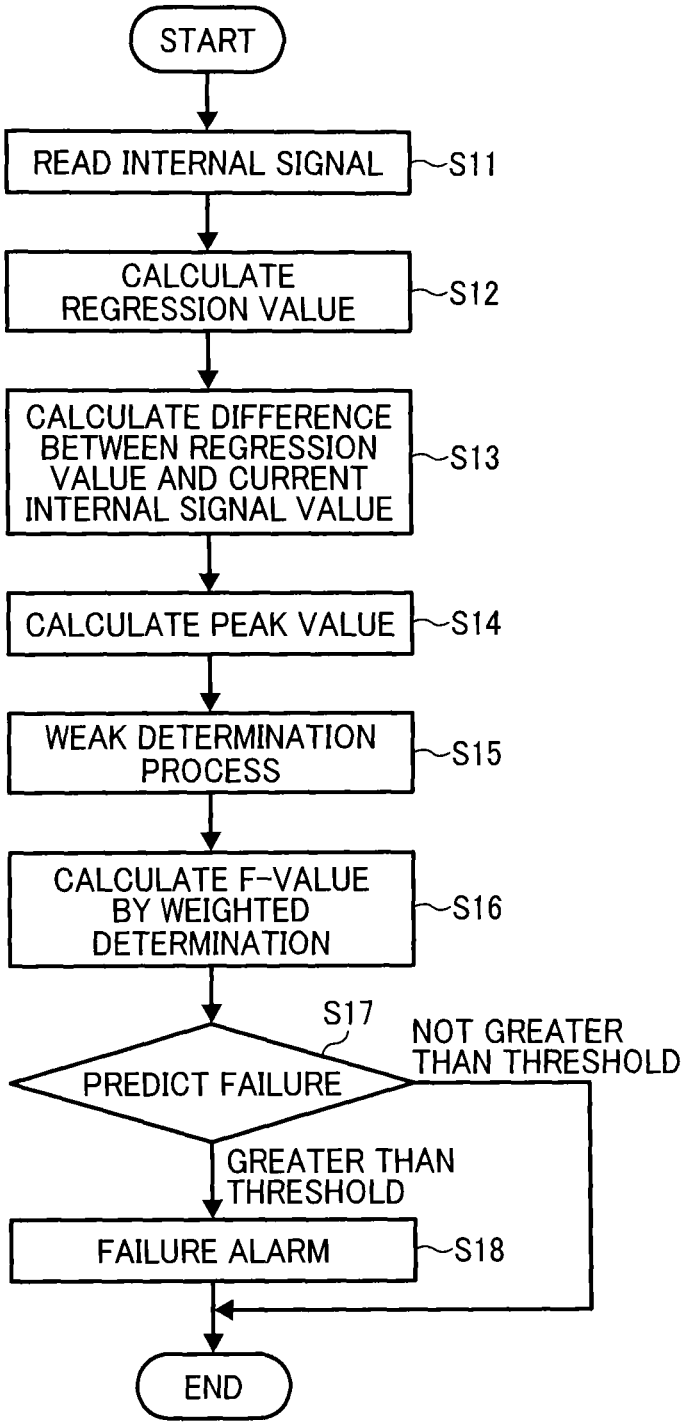
FIG. 8 is a flowchart of a failure prediction control process according to a second embodiment of the present invention.

FIG. 8 is a flowchart of a failure prediction control process according to a second embodiment of the present invention.

In the failure prediction control process according to the second embodiment, a regression value of an internal signal is calculated to use a peak value of the difference between the regression value and the current value as a feature amount. In addition, weak determination is performed using the stamp weak classifier 93*a* created by boosting to make a preliminary failure diagnosis.

In step 11 (S11), an internal signal is read. In step 12 (S12), a regression value is calculated. In step 13 (S13), the difference between the regression value and the current internal signal value is calculated. In step 14 (14), a peak value is calculated. In step (S15), a weak determination process is performed using the stamp weak classifier 93*a*. In step 16 (S16), an F-value is calculated by weighted determination. In step 17 (S17), a failure is predicted. If the peak value is greater than a threshold, a failure alarming is performed in step 18 (S18). If not, the failure alarming is not performed to complete the process.

Comparatively, failure prediction has hitherto been performed according to changes of an internal signal gradually deteriorating. In such a way, a failure or deterioration cannot be predicted according to a sign that shows an unexpected, drastic change of internal signal value due to failure or deterioration. By contrast, in the embodiments of the present invention, an unexpected failure can be predicted by taking a plurality of peak values for a prescribed period of time.

In comparative failure prediction, a failure may be predicted if an internal signal value exceeds a threshold unexpectedly, at least once. However, the internal signal may go back to a stable state after the single, unexpected change. In such a case, even if a target device is not in a failure state, a "failure" may be erroneously indicated. By contrast, in the embodiments of the present invention, taking the plurality of peak values prevents such erroneous indication. In addition, it can be determined whether an internal signal is in a stable state or in an unstable state after an unexpected, drastic change by setting individual criteria for the plurality of peak values. There has been failure prediction by taking a plurality of peak values. However, it cannot be determined by an average of the plurality of peak values whether the internal signal shows a single, unexpected change or continuous drastic changes. By contrast, in the embodiments of the present invention, it is determined by the individual criteria set for the plurality of peak values whether the internal signal shows a single, unexpected change or continuous drastic changes.

Additionally, in the embodiments of the present invention, the peak values are accurately extracted with the difference between a value of internal data and a regression value of the internal data. Accordingly, a failure can be accurately predicted.

The embodiments of the present invention provide the stamp weak classifier 93*a* created by boosting to make a preliminary failure diagnosis. Accordingly, the CPU la can execute calculation fast, resulting in accurate prediction.

Using the preliminary failure diagnosis thus calculated, weighted majority decision is performed to diagnose a failure fast and accurately.

Moreover, a failure can be accurately predicted using a parameter that indicates fluctuation of a developing ability, in other words, using a developing γ that drastically changes before a failure occurs.

The image forming apparatus 1000 includes the indicator 95 that indicates signs of failure if it is determined that a target device shows signs of failure. Accordingly, e.g., users can be notified that a failure may occur in the target device shortly, thereby preventing a drop in productivity.

It is to be noted that the number of constituent elements and their locations, shapes, and so forth are not limited to any of the structure for performing the methodology illustrated in the drawings.

For example, the prescribed period of time for obtaining peak values can be any period of time. The number of peaks can be any number. The device to predict a failure is not limited to an image forming apparatus. If a failure of the image forming apparatus is predicted, a monitored device is not limited to a development device, but can be any device.

The image forming apparatus may have any configuration as long as the present invention is applicable. The image forming apparatus is not limited to a copier. Alternatively, the image forming apparatus may be a printer, a facsimile machine, or a multifunction device having a plurality of capabilities.

The present invention has been described above with reference to specific embodiments. It is to be noted that the present invention is not limited to the details of the embodiments described above, but various modifications and enhancements are possible without departing from the scope of the invention. It is therefore to be understood that the present invention may be practiced otherwise than as specifically described herein. For example, elements and/or features of different illustrative embodiments may be combined with each other and/or substituted for each other within the scope of the present invention.

What is claimed is:

1. A device failure predictor comprising:

a data acquisition unit to acquire internal data of a target device;

a peak value calculator to calculate a plurality of peak values of the internal data for a prescribed period of time; and a failure sign identification unit to set individual criteria for the plurality of peak values and determine whether or not the target device shows signs of failure according to the plurality of peak values and the individual criteria.

2. The device failure predictor according to claim 1, further comprising a pre-processor to calculate a difference between a value of the internal data and a regression data of the internal data, wherein the peak value calculator calculates a peak value according to the difference, and wherein the failure sign identification unit determines whether or not the target device shows signs of failure according to the peak value.

3. The device failure predictor according to claim 1, wherein the failure sign identification unit comprises a stamp weak classifier created by boosting to make a preliminary failure diagnosis.

4. The device failure predictor according to claim 3, wherein the failure sign identification unit further comprises a weighted majority-decision calculator to diagnose a failure by weighted majority decision using the preliminary failure diagnosis.

5. An image forming apparatus comprising a device failure predictor, the device failure predictor comprising:

a data acquisition unit to acquire internal data of a target device;

a peak value calculator to calculate a plurality of peak values of the internal data for a prescribed period of time; and a failure sign identification unit to set individual criteria for the plurality of peak values and determine whether or not the target device shows signs of failure according to the plurality of peak values and the individual criteria.

6. The image forming apparatus according to claim 5, further comprising a developing device to develop an electrostatic latent image into a toner image, wherein the device failure predictor predicts a failure using a parameter that indicates fluctuation of a developing ability of the developing device.

7. The image forming apparatus according to claim 5, further comprising an indicator to indicate signs of failure if the device failure predictor determines that the target device shows signs of failure.

* * * * *